US006837167B2

(12) United States Patent
Henderson

(10) Patent No.: US 6,837,167 B2
(45) Date of Patent: Jan. 4, 2005

(54) ELEVATED OPEN-CENTER TRANSIT GUIDEWAY WITH OPEN-MESH SCREEN EMERGENCY WALKWAY

(76) Inventor: J. Kirston Henderson, 1709 Ridgmar Blvd., Fort Worth, TX (US) 76116-2016

( * ) Notice: Subject to any disclaimer, the term of this patent is extended or adjusted under 35 U.S.C. 154(b) by 0 days.

(21) Appl. No.: 10/701,815

(22) Filed: Nov. 5, 2003

(65) Prior Publication Data

US 2004/0089189 A1 May 13, 2004

Related U.S. Application Data

(63) Continuation of application No. 10/116,223, filed on Apr. 4, 2002.
(60) Provisional application No. 60/281,963, filed on Apr. 6, 2001.

(51) Int. Cl.[7] ..... B61B 12/04
(52) U.S. Cl. ..... 104/124; 104/28
(58) Field of Search ..... 104/124, 125, 104/126, 27, 28, 30

(56) References Cited

U.S. PATENT DOCUMENTS

| | | | | |
|---|---|---|---|---|
| 4,236,601 A | * | 12/1980 | Naka | 182/76 |
| 4,615,275 A | * | 10/1986 | Ishizuka | 105/438 |
| 5,566,620 A | * | 10/1996 | Siewert | 104/124 |
| 6,039,135 A | | 3/2000 | Henderson | |
| 6,357,358 B2 | | 3/2002 | Henderson | |

* cited by examiner

*Primary Examiner*—S. Joseph Morano
*Assistant Examiner*—Robert J. McCarry, Jr.
(74) *Attorney, Agent, or Firm*—Bracewell & Patterson, L.L.P.

(57) ABSTRACT

An elevated transit system has a pair of spaced apart guideways for supporting a vehicle. The guideways are supported on vertical columns above the ground. An emergency walkway extends between the guideways The walkway has a plurality of apertures to allow the passage of sunlight to the ground below.

4 Claims, 5 Drawing Sheets

ELEVATED OPEN-CENTER TRANSIT GUIDEWAY WITH OPEN-MESH SCREEN EMERGENCY WALKWAY

CROSS REFERENCE TO RELATED APPLICATION

This application is a continuation of application Ser. No. 10/116,223 filed Apr. 4, 2002, and claims the benefit of provisional application 60/281,963, filed Apr. 6, 2001.

1. FIELD OF INVENTION

This invention relates in general to a transit system having a pair of spaced-apart guideways for receiving wheels of a vehicle and an open-mesh walkway located between the guideways for allowing passengers to disembark from the transit system in the event of a malfunction.

2. BACKGROUND OF THE INVENTION

This invention deals with transit systems that elevate a passenger vehicle as well as automatically control the operation of the vehicle, such as monorails as well as systems where vehicles roll on a guideway. An advantage of an elevated transit system is that it does not interfere with conventional vehicles located on the ground. However, generally an elevated system creates a substantial obstruction to sunlight to the ground below. Also, an elevated system should have an emergency walkway for passengers to disembark in the event of a malfunction. If so, the walkway adds to the width of the guideway and increases the shadow cast on the ground below. These systems result in a dead zone to the ground beneath the guideway.

In U.S. Pat. No. 6,039,135, a transit system is disclosed that has spaced-apart guideways that are open between them to allow sunlight to pass to the ground below. However, this patent does not disclose any provision for allowing passengers to disembark in the event of a malfunction.

3. SUMMARY OF THE INVENTION

The transit system of this invention has a pair of spaced-apart guideways for supporting a vehicle. The space between the guideways is open to allow sunlight to pass. The guideways are elevated and supported on a plurality of vertical columns. An emergency walkway is located in the open space between the guideways. The walkway has a plurality of apertures for the passage of sunlight to the ground below. Preferably, the walkway comprises a plurality of open-mesh plates that are retained on beams and on the guideways.

4. BRIEF DESCRIPTION OF THE DRAWINGS

FIG. 1 is a perspective view showing a transit system constructed in accordance with this invention.

FIG. 2*a* is an enlarged sectional view of the transit system of FIG. 1, taken along the line 2—2 of FIG. 1.

FIG. 2*b* is a further enlarged view of an edge portion of the walkway for the transit system as shown in FIG. 2*a*.

5. DETAILED DESCRIPTION OF INVENTION

Figure 1:
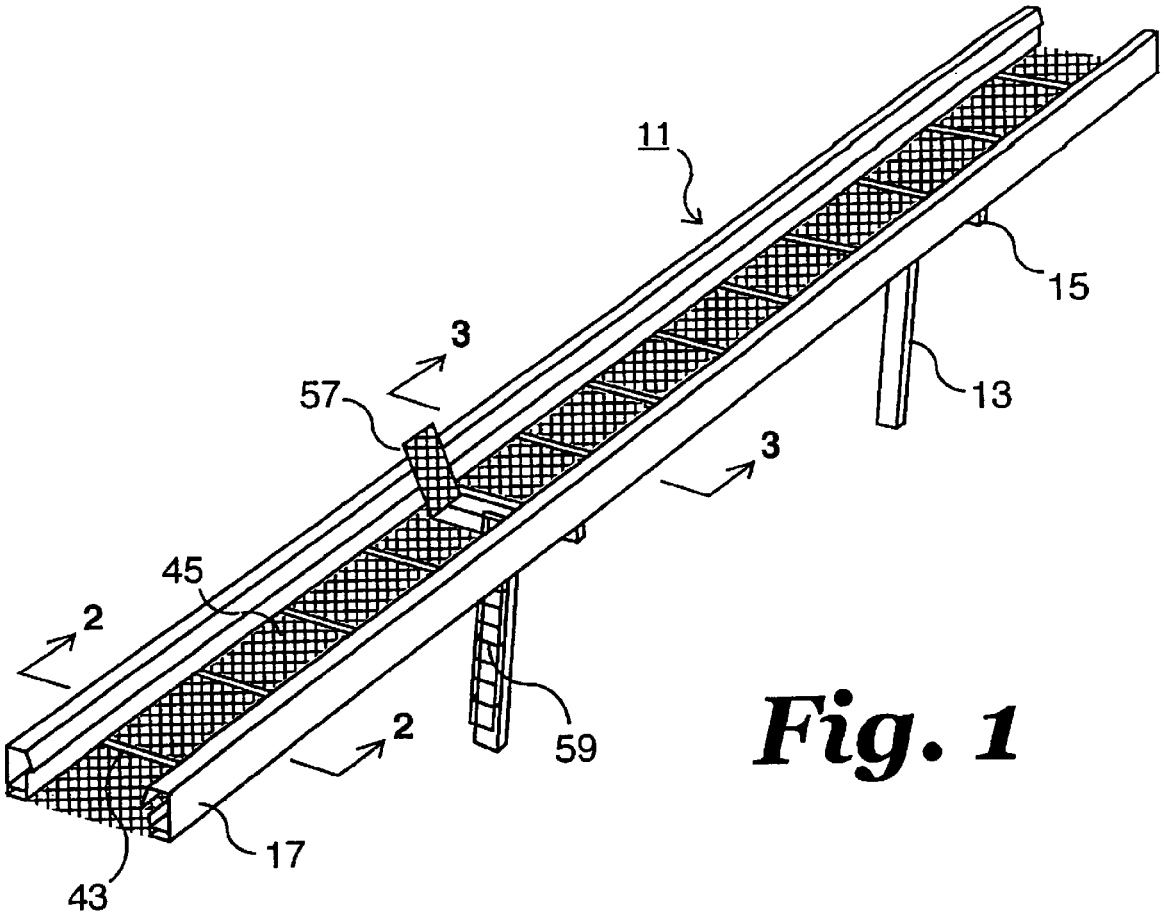

Referring to FIG. 1, transit system 11 has a plurality of vertical columns 13 that are supported in the ground. Columns 13 are spaced apart, and each column 13 has a cross member 15 at its upper end. A pair of guideways 17 are supported on cross members 15.

Referring to FIG. 2, guideways 17 preferably are hollow, longitudinally extending members. Each guideway 17 has a bottom 19, a top 21 and an outer side wall 23. An inner side wall has an upper portion 25 and a lower portion 27. Upper portion 25 inclines downward and inward from top 21. Lower portion 27 extends upward vertically, parallel with outer side wall 23. Upper portion 25 thus overhangs the upper edge of lower portion 27. This results in a longitudinally extending slot 29 that is about midway between bottom 19 and top 21. Electrical power and control lines 31 are located within guideway 17, preferably on the inside of outer sidewall 23. A track 33 may be located above bottom 19 creating a space above bottom 19 that receives cables and the like.

Figure 6:
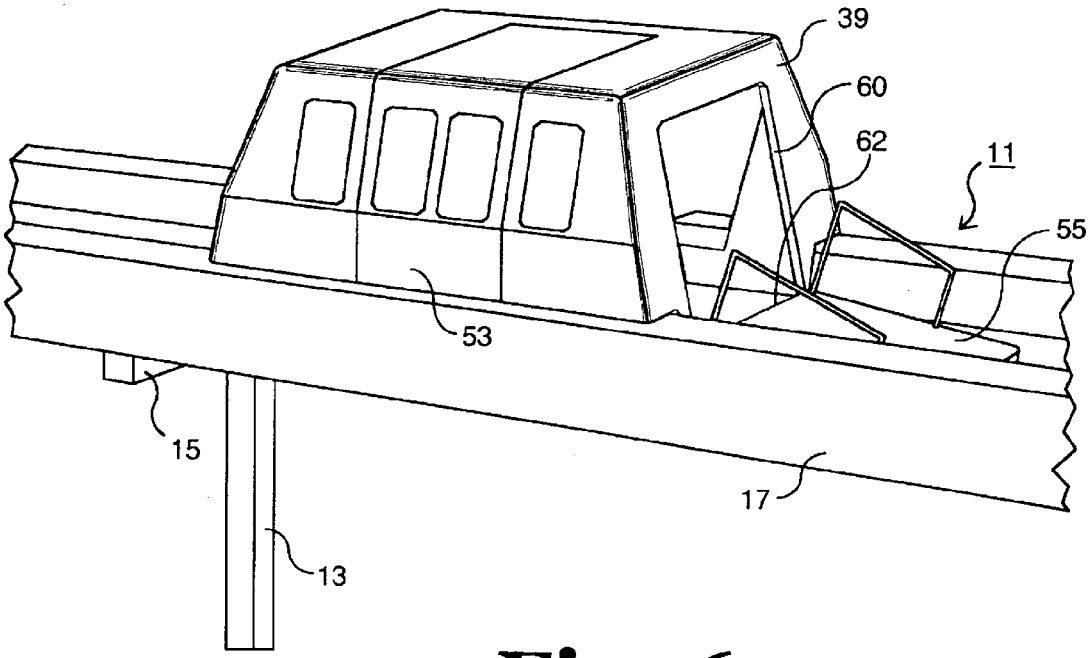
FIG. 6 is a perspective view of the transit system of FIG. 1, showing a vehicle located thereon.

A wheel 35 of a vehicle 39 is adapted to fit within each guideway 17. Wheel 35 is shown in rolling contact with track 33. Wheel 35 is mounted on an axle 37 that has an offset portion so that it will extend through slot 29. Vehicle 39 may be for carrying passengers, as shown in FIG. 6, for carrying cargo, or for carrying a conventional motor vehicle, such as a ferry. Vehicle 39 has electrical pickups (not shown) that interact with the power and control lines 31 for supplying power and steering. Wheels 35 may be powered for moving vehicle 39. Alternately, vehicle 39 could utilize magnetic levitation or air cushion levitation, in which case wheels 35 would primarily be used while stopped.

Figure 2A:
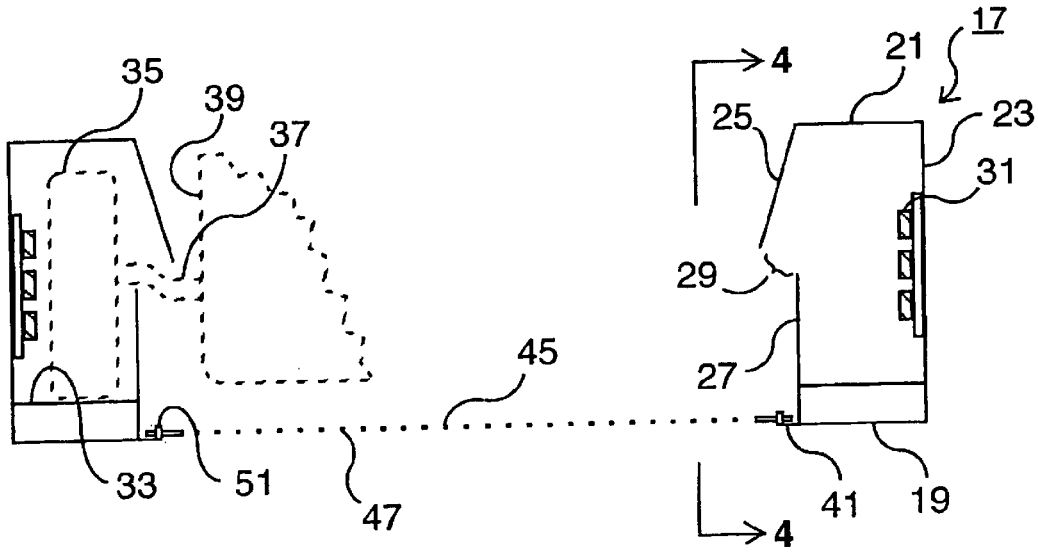
Figure 3:
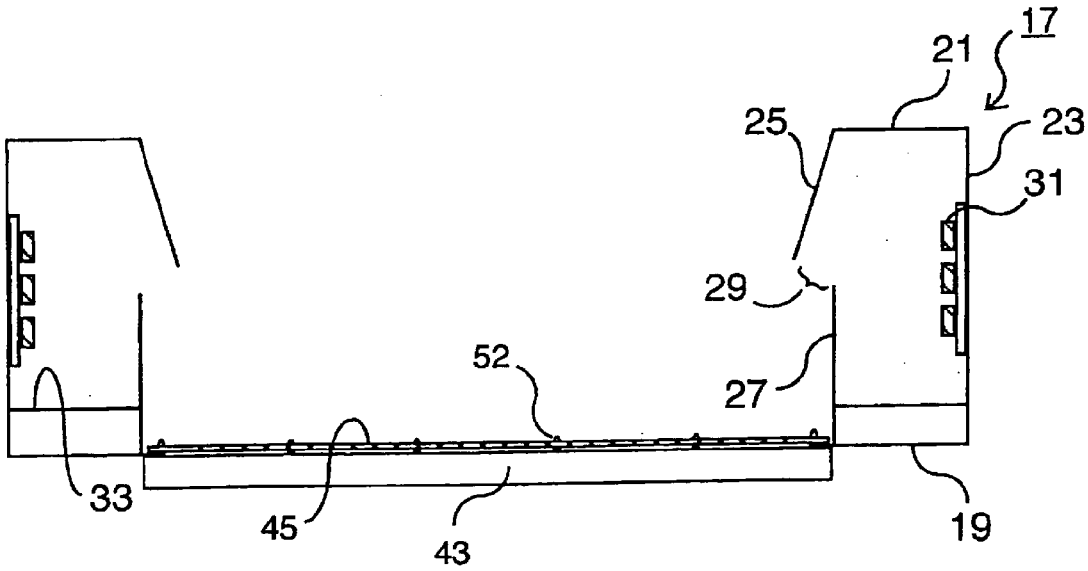
FIG. 3 is a sectional view of the transit system of FIG. 1, taken along the line 3—3 of FIG. 1.

Referring still to FIG. 2*a*, a flange or lip 41 extends inwardly from inner side wall lower portion 27. Lip 41 is preferably flush with bottom 19. As shown in FIGS. 1 and 3, in addition to cross members 15, a plurality of beams 43 extend between guideways 17. Beams 43 are spaced at a closer distance, typically 4 feet, while cross members 15 are farther apart, such as 48 feet. The upper ends of beams 43 are substantially flush with lips 41 and are secured to the inner lower portion 27 or bottom 19 by any suitable means, such as fasteners or welding.

Figure 5:
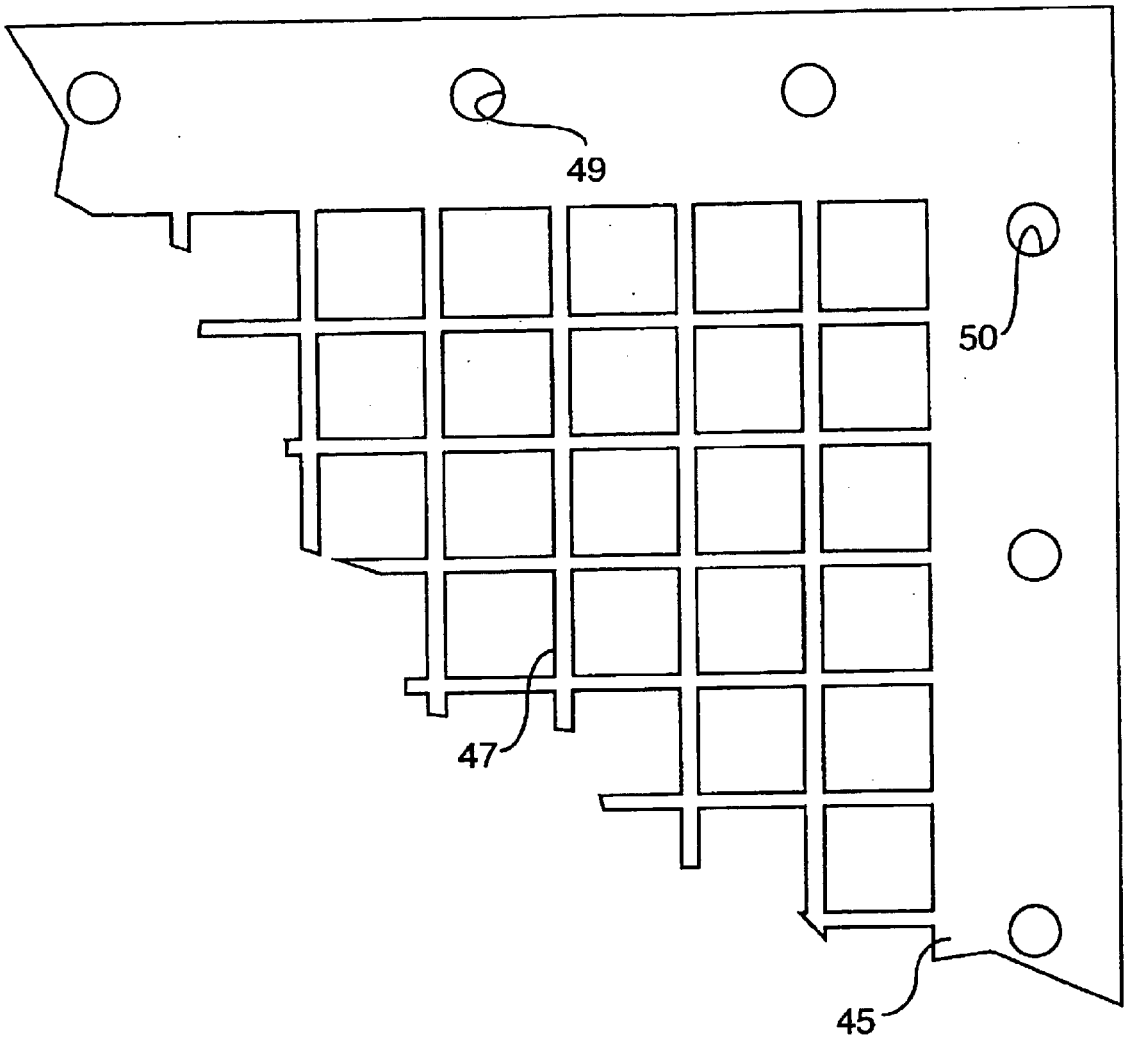
FIG. 5 is an enlarged, partial plan view of a portion of the walkway of the transit system of FIG. 1.

Referring to FIG. 1, a plurality of walkway plates 45 are supported on beams 43 and lips 41. Each walkway plate 43 has one side edge on one lip 41 and another side edge on the other lip 41. Each walkway plate 45 preferably has a length sufficient to extend from one beam 43 to the next beam 43. As shown in FIG. 5, each plate 45 is a flat metal member having a plurality of apertures 47 cut in it to form an open mesh. Apertures 47 are shown to be rectangular, but could be any configuration, such as diamond shaped or circular. Plate 45 could alternately be made of flat vertically oriented metal strips spaced apart and welded together in a grid. Plate 45 could even be made of parallel, spaced-apart rods. In the preferred embodiment, a plurality of transversely extending holes 49 are spaced across the width on a perimeter or border of each walkway plate 45. Similar holes 50 extend along a longitudinal margin of each walkway plate 45.

Figure 2B:
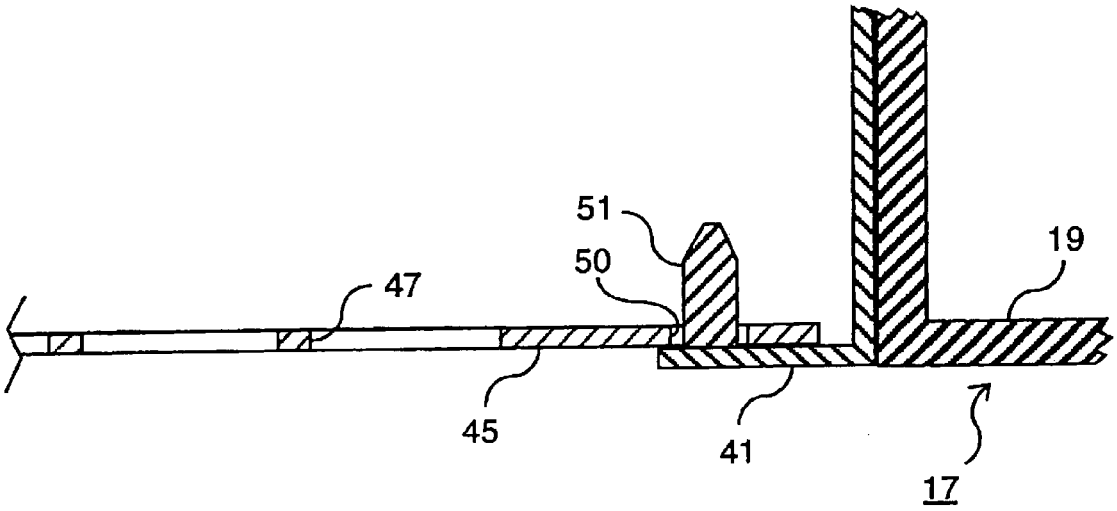
Figure 4:
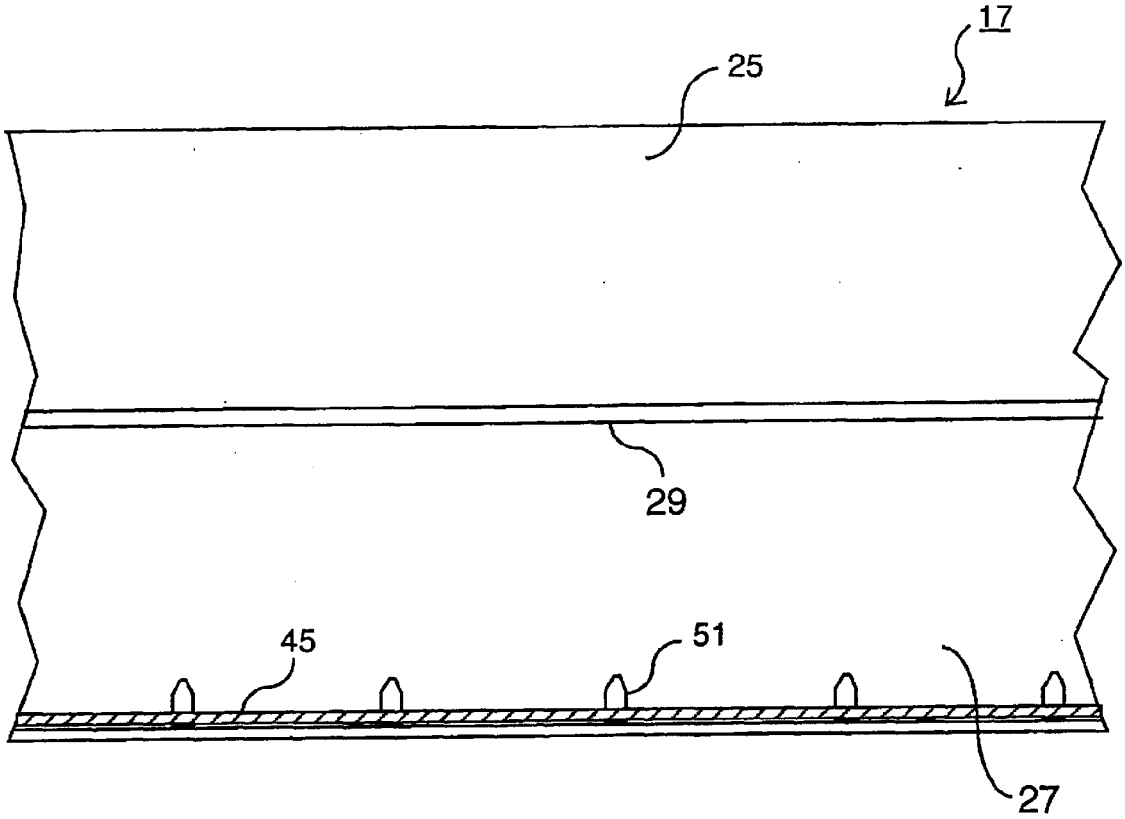
FIG. 4 is a further enlarged sectional view of the transit system of FIG. 2*a*, taken along the line 4—4 of FIG. 2*a*.

Referring to FIGS. 2*b* and 4, a plurality of retainer pins 51 are secured to each lip 41 and extend upward for receiving one of the longitudinally spaced holes 50. Similarly, each beam 43 has a plurality of transversely spaced apart pins 52 FIG. 3) for receiving one of the transversely spaced holes 49

(FIG. 5). Pins 51 and 52 thus retain each walkway plate 45 on lips 41 and beams 43. Rather than pins, walkway plates 45 may be retained in other manners, such as by threaded fasteners, welding, or longitudinal and lateral guide members. Also, retainer pins 51 and 52 could be mounted to the walkway plates 45 rather than to the beams 43 and lips 41.

Figure 7:
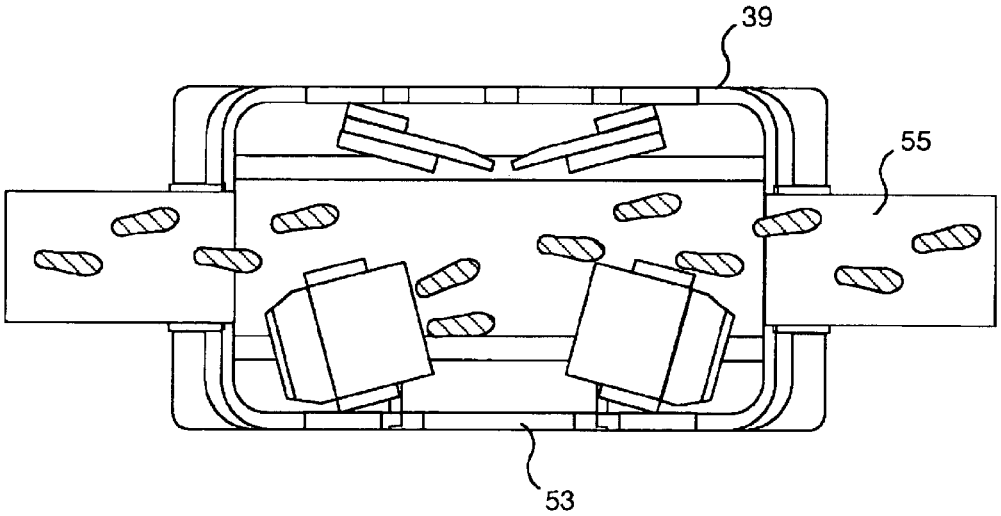
FIG. 7 is a top view of the vehicle in FIG. 6, with the roof removed.

Referring to FIG. 6, in this embodiment, vehicle 39 is a passenger vehicle. It has a side door 53 for passengers to enter and depart. Vehicle 39 further has two emergency doors 55, one on the front end and one on the rear end. Emergency doors 55 are hinged by a horizontal hinge 62 on the bottom edge of the emergency door 55 that is permanently connected to the bottom edge of the door frame 60 on the vehicle 39, such that the emergency doors 55 fold downwardly about the horizontal hinge 62, serving as a ramp between vehicle 39 and walkway plates 45 (FIG. 1). FIG. 6 shows one emergency door 55 lowered, and FIG. 7 illustrates both emergency doors 55 lowered. The footprints, shown in FIG. 7 indicate that in the event of an emergency, passengers could walk straight through multiple stalled vehicles 39 to a place on the transit system 11 where they could safely disembark from system 11.

Referring again to FIG. 1, portals 57 may be spaced periodically along transit system 11. In this case, each portal 57 comprises a trap door in one of the walkway plates 45. Trap door 57 can be lifted upward as shown in FIG. 1, or closed to a lower position. Portal 57 leads to a ladder 59, which is mounted to one of the columns 13.

In operation, should a malfunction occur that stalls vehicle 39 (FIG. 6), the passengers open one or both emergency doors 55 and depart from vehicle 39. The passengers walk along walkway plates 45 to a safe point for exiting the transit system 11. The safe point may be a station, if nearby. Alternately, the safe point could be through one of the portals 57, shown in FIG. 1, which provides access to ladder 59.

The invention has significant advantages. The open-mesh walkway allows passengers to safely escape from a vehicle. The walkway does not significantly block sunlight because it is of an open mesh-type. Also, the walkway does not increase the width of the transit system. While walking along the walkway, the passengers are prevented from inadvertent contact with the power and control lines because they are located within the enclosed guideways. Also, the enclosed guideways, which extend above the walkway on each side, serve as a safety rail for the passengers.

While the invention has been shown in only one of its forms, it should be apparent to those skilled in the art that it is not so limited but susceptive to various changes without departing from the scope of the invention.

I claim:

1. A transit system for moving passengers, comprising:

a plurality of upright columns having lower ends supported in the ground;

a cross member located at an upper end of each of the columns;

a pair of spaced-apart guideways extending between the columns and supported on the cross-members;

a vehicle that is carried on the guideways;

a plurality of beams extending between the guideways;

a plurality of mesh walkway plates extending between the guideways and supported by the beams for allowing passengers of the vehicle to disembark from the vehicle and the transit system in the event of a malfunction, the walkway plates allowing sunlight to pass through to the ground, the walkway plates extending fully from one of the guideways to the other of the guideways;

a side door on the vehicle for normal ingress and egress;

front and rear emergency doors on the vehicle, to allow passengers to move from the walkway plates outside one end of the vehicle to the walkway plates outside the other end of the vehicle by passing through emergency doors at both ends of the vehicle; and wherein the emergency doors comprise folding ramps to facilitate access to the walkway plates.

2. The transit system of claim 1, further comprising a portal in one of the walkway plates for allowing a passenger walking along the walkway plates to descend below the walkway plates to the ground.

3. A transit system for moving passengers, comprising:

a plurality of upright columns having lower ends supported in the ground;

a cross member located at an upper end of each of the columns;

a pair of spaced-apart guideways extending between the columns and supported on the cross-members;

a vehicle that is carried on the guideways;

a plurality of beams extending between the guideways;

a plurality of mesh walkway plates extending between the guideways and supported by the beams for allowing passengers of the vehicle to disembark from the vehicle and the transit system in the event of a malfunction, the walkway plates allowing sunlight to pass through to the ground, each of the walkway plates extending fully from one of the guideways to the other of the guideways;

a side door on the vehicle for normal ingress and egress;

a pair of door frames, wherein one of the door frames is stationarily fixed to one of the ends of the vehicle, and the other of the door frames is stationarily fixed to the other of the ends of the vehicle; and a bottom edge of a door horizontally hinged and permanently connected to a bottom edge of each door frame, each door openable only by folding the door downward about the permanently connected horizontal hinge into contact with the walkway plates, forming a ramp whereby passengers can move through the door at one of the ends, through the inside of the vehicle, and through the door at the other of the ends.

4. A method for moving passengers, comprising:

(a) providing a transit system having a cross member located on upper ends of each of a plurality of columns, a plurality of guideways extending between the columns and supported on the cross members, mesh walkway plates extending between the guideways fully from one of the guideways to the other of the guideways, and emergency exits spaced along the transit system;

(b) providing a plurality of vehicles that are unattached and independently operable from each other, wherein each vehicle is carried on the guideways, and wherein each vehicle comprises a side door and front and rear emergency doors;

(c) embarking passengers into the side door of the vehicles, and moving each of the vehicles with the passengers along the guideways, wherein each vehicle is moving independent of the other unattached vehicles;

(d) in the event of the vehicles making an emergency stop on the guideways prior to reaching a desired destination, folding the front and rear emergency doors of each of the stopped vehicles downward into contact with the walking plates to form ramps;

(e) causing the passengers to disembark through one of the emergency doors onto the walkway plates and walk toward an emergency exit; and (f) in the event of a stopped vehicle blocking the path to an emergency exit, causing the passengers of the other vehicles to walk through the emergency doors of the blocking vehicle en route to the emergency exit.

* * * * *